US010577563B2

(12) United States Patent
Sears et al.

(10) Patent No.: US 10,577,563 B2
(45) Date of Patent: Mar. 3, 2020

(54) PETROLEUM DISTILLATES WITH INCREASED SOLVENCY

(71) Applicant: Refined Technologies, Inc., Spring, TX (US)

(72) Inventors: Sean Sears, Spring, TX (US); Edward Alverson, Spring, TX (US)

(73) Assignee: Refined Technologies, Inc., Spring, TX (US)

( * ) Notice: Subject to any disclaimer, the term of this patent is extended or adjusted under 35 U.S.C. 154(b) by 65 days.

(21) Appl. No.: 15/808,545

(22) Filed: Nov. 9, 2017

(65) Prior Publication Data

US 2018/0134991 A1 May 17, 2018

Related U.S. Application Data

(60) Provisional application No. 62/420,254, filed on Nov. 10, 2016.

(51) Int. Cl.

| | |
|---|---|
| ***C11D 3/20*** | (2006.01) |
| ***C11D 3/32*** | (2006.01) |
| ***B08B 3/08*** | (2006.01) |
| ***C11D 1/52*** | (2006.01) |
| ***C11D 1/92*** | (2006.01) |
| ***C11D 1/90*** | (2006.01) |

(Continued)

(52) U.S. Cl.

CPC ..... *C11D 1/521* (2013.01); *B08B 3/08* (2013.01); *B08B 3/10* (2013.01); *B08B 9/02* (2013.01); *B08B 9/027* (2013.01); *B08B 9/032* (2013.01); *C11D 1/523* (2013.01); *C11D 1/66* (2013.01); *C11D 1/90* (2013.01); *C11D 1/92* (2013.01); *C11D 3/18* (2013.01); *C11D 3/32* (2013.01); *C11D 3/43* (2013.01); *C11D 11/0041* (2013.01)

(58) Field of Classification Search

CPC .... C11D 1/66; C11D 3/18; C11D 3/43; C11D 3/32; B08B 3/08; B08B 3/10; B08B 9/02; B08B 9/027; B08B 9/032

USPC ..... 510/183, 184, 185, 188, 197, 245, 264, 510/501; 134/19, 20, 22.11, 22.18, 34, 134/35, 40

See application file for complete search history.

(56) References Cited

U.S. PATENT DOCUMENTS

| | | | |
|---|---|---|---|
| 6,302,209 | B1 | 10/2001 | Thompson, Sr. et al. |
| 2007/0224249 | A1 | 9/2007 | Kelly et al. |

(Continued)

OTHER PUBLICATIONS

Abd, Rasha Mohammed, Nour, Abdurhman H. and Sulaiman, Ahmad Ziad, "Experimental Investigation on Dynamic Viscosity and Rheology of Water-Crude Oil Two Phases Flow Behavior at Different Water Volume Fractions." 2014 AJER vol. 3, No. 3, pp. 113-120. www.ajer.org.

(Continued)

*Primary Examiner* — Gregory R Delcotto
(74) *Attorney, Agent, or Firm* — Blank Rome, LLP

(57) ABSTRACT

Certain fatty acid amide-based surfactants such as cocamide DEA (also known as "coco(nut) diethanolamide" or "coco (nut) DEA") when dissolved or dispersed in a cutting oil (diesel, light cycle oil, naphtha, and such other petroleum distillates) produce a petroleum distillate having significantly enhanced solvency for heavy residuals. Such solutions or dispersions are especially useful for cleaning vessels and similar equipment in refineries by circulating the solution or dispersion in the vessel, optionally with the application of heat.

14 Claims, 1 Drawing Sheet

(51) Int. Cl.

| | |
|---|---|
| ***C11D 3/18*** | (2006.01) |
| ***C11D 11/00*** | (2006.01) |
| ***C11D 3/43*** | (2006.01) |
| ***B08B 9/032*** | (2006.01) |
| ***C11D 1/66*** | (2006.01) |
| ***B08B 3/10*** | (2006.01) |
| ***B08B 9/027*** | (2006.01) |
| ***B08B 9/02*** | (2006.01) |

(56) References Cited

U.S. PATENT DOCUMENTS

| | | | | |
|---|---|---|---|---|
| 2008/0138327 | A1 | 6/2008 | Kelly et al. | |
| 2010/0186767 | A1 | 7/2010 | Martin | |
| 2012/0318514 | A1 | 12/2012 | Mesher | |
| 2014/0096732 | A1 | 4/2014 | Boons et al. | |
| 2014/0357533 | A1 | 12/2014 | Wells et al. | |
| 2014/0367110 | A1 | 12/2014 | Montgomery et al. | |
| 2015/0233223 | A1 | 8/2015 | AlAmeri et al. | |
| 2015/0267152 | A1* | 9/2015 | Matza | C11D 11/0041 510/366 |
| 2015/0315520 | A1 | 11/2015 | Eppler et al. | |
| 2016/0009981 | A1 | 1/2016 | Teklu et al. | |
| 2016/0069159 | A1 | 3/2016 | Teklu et al. | |
| 2016/0122616 | A1 | 5/2016 | Fu et al. | |
| 2016/0177226 | A1* | 6/2016 | Bennett | C11D 3/2006 507/243 |
| 2016/0312160 | A1* | 10/2016 | Matza | C11D 1/62 |
| 2016/0326463 | A1* | 11/2016 | Reinke | C11D 1/886 |

OTHER PUBLICATIONS

Abd, Rasha Mohammed, Nour, Abdurhman H. and Sulaiman, Ahmad Ziad, "Kinetic Stability and Rheology of Water-in-Crude Oil Emulsion Stabilized by Cocamide at Different Water Volume Fractions." Apr. 2014 International Journal of Chemical Engineering and Applications, vol. 5, No. 2, pp. 204-209.

Ridzuan, N., Adam, F. and Yaacob, Z., "Effects of Shear Rate and Inhibitors on Wax Deposition of Malaysian Crude Oil." 2015 Oriental Journal of Chemistry vol. 31, No. 4, pp. 1999-2004. ISSN: 0970-020 X.

* cited by examiner

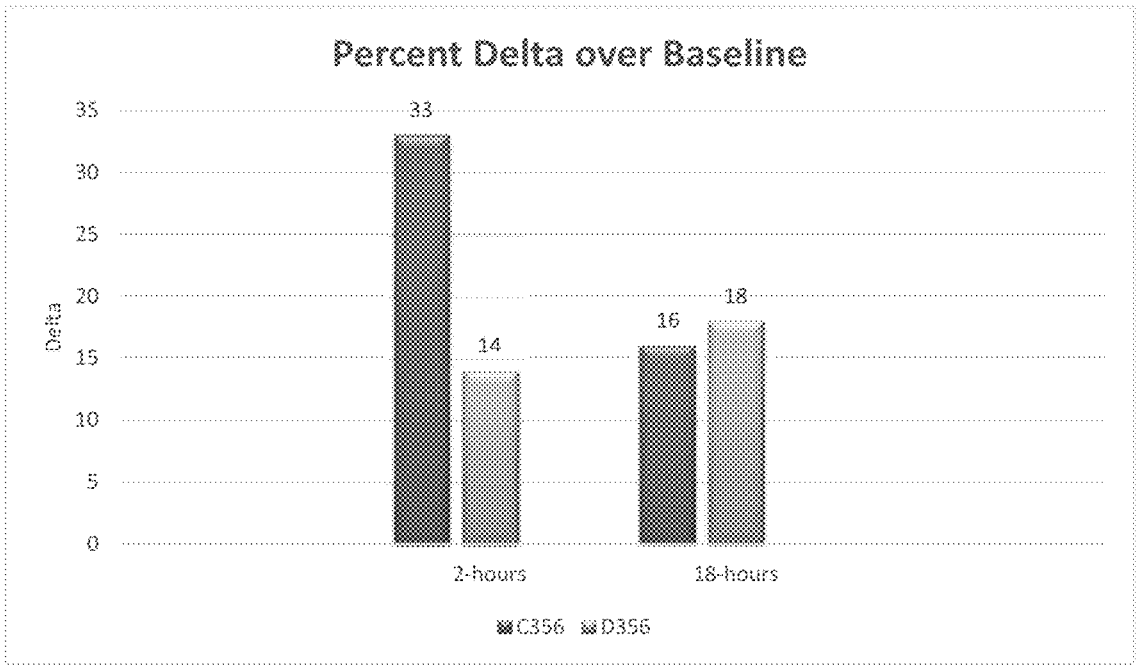
Percent Delta over Baseline
Delta
35
30
25
20
15
10
5
0
33
14
16
18
2-hours
18-hours
C356
D356

PETROLEUM DISTILLATES WITH INCREASED SOLVENCY

CROSS-REFERENCE TO RELATED APPLICATIONS

This application claims the benefit of U.S. Provisional Application No. 62/420,254, filed Nov. 10, 2016, the contents of which are hereby incorporated by reference in their entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to solvents. More particularly, it relates to non-aqueous solvents used to clean refinery equipment.

2. Description of the Related Art Including Information Disclosed Under 37 CFR 1.97 and 1.98

This invention relates to materials and processes for cleaning the internal surfaces of organically contaminated, large, closed-vessel pieces of equipment (e.g., distillation vessels) and other such equipment that can be isolated either individually or collectively in closed "circuits" located in refineries, and other such facilities.

A "turnaround" in the refining industry is the process of taking single or multiple vessels off-line for maintenance and/or inspection. Multiple maintenance applications may be performed during this time, including the replacement of valves, pipes, trays, spargers, packed sections, boilers, exchangers, and other components.

A "squat," which is a limited, less time-consuming version of a turnaround, usually involves taking only part of a section off-line (e.g., the vacuum vessel but not the atmospheric vessel).

A turnaround may be performed for several reasons, some of which are mandated by government agencies and others determined by refinery operational needs. The government requires inspections of distillation vessels for safety reasons. In addition to mandated inspections, the refinery also may take a pipestill section, or a particular distillation vessel, off-line if it believes that the pipestill performance can be improved by modifying existing equipment or by performing planned or unplanned maintenance.

Thus, a turnaround is an infrequent opportunity for the refinery operator to enhance the performance of the vessel(s), thus increasing overall efficiency. Processes in the refinery are intimately connected, thus deficiencies or enhancements in a single piece of equipment can significantly affect downstream applications and costs.

The timing of a turnaround, and the amount of time that the vessels are off-line, is very critical to the profitability of a refinery. As in other continuous process industries where demand for the product is also continuous, idle equipment often causes an irreversible loss of revenue. In the case of a refinery, one day lost in production may cause several millions of dollars to be lost in revenue. Because of this, refineries will spend several months planning every step of the turnaround process in order that it may be done quickly, safely, and efficiently. A reduction of days, or even hours, from the turnaround process gains the refinery significant marginal income.

During a turnaround, and before internal mechanical maintenance of any kind is performed, a cleaning must take place which frees contaminants from internal surfaces of the refinery components. These internal surfaces may include the walls of the vessel cylinder, the tops and bottoms of trays, packing sections (loose or fixed), spargers, pump-around piping, and especially the bottom third of the vessel. The bottom section is typically very difficult to clean since it is the area that produces the heavier factions of hydrocarbons. The quicker this cleaning is accomplished, the sooner cleanliness standards may be met. Until the required degree of cleanliness is achieved, workers are not permitted entry into the vessel.

The contaminants removed may include any hydrocarbon that is found in crude oil. These hydrocarbons vary in size, length, molecular weight and structure. The industry refers to these different structures as Light End, Medium and Heavy. Light Ends are cuts such as methane, propane, ethane, and the like. Medium cuts include kerosene, gasoline, and diesel, among others. Heavy cuts encompass lubricants, waxes and asphalt.

There are several reasons why distillation vessels and other supporting equipment must be effectively cleaned before interior maintenance is performed.

A first reason involves the removal of dangerous fumes. If the hydrocarbons are not effectively cleaned from the vessel, an accumulation of by-product fumes (e.g., $H_2S$ gas) may remain. These gases may be deadly, especially when the exposure occurs within a confined space. By federal law, refinery operators must reduce hydrocarbon levels below industry maximums before allowing people to enter the vessel to perform work. If levels are not low enough, the vessel must either be re-cleaned or vented to the atmosphere for hours or even days.

A second reason involves the reduction of fire hazards. It is not uncommon for welders to accidentally set vessels on fire during mechanical work if the vessels are not cleaned thoroughly. This level of cleanliness is especially important in the packed sections of a vessel which may trap significant quantities of hydrocarbons, causing high lower explosive limit (LEL) readings upon entry if not properly cleaned. Therefore, the refinery components must be thoroughly cleaned to prevent accidental fires.

A third reason involves enabling more effective visual inspections. It takes operators and inspectors longer to inspect a vessel if the vessel is not properly cleaned. This is because inspectors are looking for signs of fatigue or cracks in the trays or walls along with other potential signs of failure. If the possibility exists for defects to be hidden by unremoved contaminants, it will take the inspector longer to determine whether such defects exist. Thus, incomplete cleaning makes the process more time-consuming and costly.

A fourth reason involves overall safety. Quite simply, the likelihood of slips, falls and other mishaps in the vessel is reduced when the metal is free of oils, waxes and greases. Therefore, thorough cleaning reduces the likelihood of injury to workers.

A fifth reason involves process efficiency. When a process vessel is contaminated, pressure drops may occur which limit the process throughput or output rates. When the contaminant is removed, flow rates may be increased with a resulting improvement in operating efficiency.

Cocamide DEA (CAS 68603-42-9) or "coconut diethanolamide" or "coco fatty acid diethanolamide" is a diethanolamide made by reacting a mixture of fatty acids from coconut oils with diethanolamine. It is a yellowish to yellow viscous liquid that is commonly used as a foaming agent or as an emulsifying agent in a variety of products. The general chemical formula of the individual components is $CH_3(CH_2)_nC(=O)N(CH_2CH_2OH)_2$, where n typically ranges from 8 to 18. Diethanolamides are common ingredients in cosmetics where they are used as foaming agents or as emulsifiers. Chemically, they are amides formed from diethanolamine and carboxylic acids, typically fatty acids. Examples other than cocamide diethanolamine include lauramide diethanolamine and oleamide diethanolamine.

Cocamide MEA (or "coco(nut) monoethanolamide") is a solid, off-white to tan compound, often sold in flaked form. The solid melts to yield a pale yellow, viscous, clear to amber liquid. It is a mixture of fatty acid amides which is produced from the fatty acids in coconut oil when reacted with ethanolamine.

Cocamide itself is a mixture of amides of the fatty acids obtained from coconut oil. Inasmuch as coconut oil is comprised of about 50% lauric acid, in formulas only the 12-carbon chains tend to be considered. Lauramide DEA is the major component of cocamide DEA. Therefore the formula of cocamide can be written as $CH_3(CH_2)_{10}CONH_2$, although the actual number of carbon atoms in the chains varies. The number of carbon atoms in the chain is always an even number.

The approximate concentration of fatty acids in coconut oil is as follows:

| | |
|---|---|
| Caprylic (saturated C8) | 7% |
| Decanoic (saturated C10) | 8% |
| Lauric (saturated C12) | 48% |
| Myristic (saturated C14) | 16% |
| Palmitic (saturated C16) | 9.5% |
| Oleic (monounsaturated (C18:1) | 6.5% |
| Other (polyunsaturated) | 5% |

Any of these fatty acids may be reacted with diethanolamine to produce a foaming agent or an emulsifying agent that may be used in an embodiment of the invention.

Cocamide is the structural basis of many surfactants. Among the most common are ethanolamines (cocamide MEA, cocamide DEA), betaine compounds (cocamidopropyl betaine), and hydroxysultaines (cocamidopropyl hydroxysultaine).

Cocamidopropyl betaine (CAPB) is an organic compound derived from coconut oil and dimethylaminopropylamine. CAPB is available as a viscous, pale yellow solution and it is used as a surfactant in personal care products. The name reflects that the major part of the molecule, the lauric acid group, is derived from coconut oil. Cocamidopropyl betaine to a significant degree has replaced cocamide DEA in personal care products. CAPB is a fatty acid amide containing a long hydrocarbon chain at one end and a polar group at the other. This allows CAPB to act as a surfactant and as a detergent. It is a zwitterion, consisting of both a quaternary ammonium cation and a carboxylate.

Cocamidopropyl hydroxysultaine (CAHS) [N,N-Dimethyl-N-(3-cocamidopropyl)-3-amino-2-hydroxypropylsulfonate] is a synthetic amphoteric surfactant from the hydroxysultaine group. It is used in personal care products (soaps, shampoos, lotions etc.) as a foam booster, viscosity builder, and an antistatic agent.

Naphtha is a general term applied to refined, partly refined, or unrefined petroleum products not less than 10% of which distill below 175° C. and not less than 95% of which distill below 240° C. when subject to distillation in accordance with the Standard Method of Test for Distillation of Gasoline, Naphtha, Kerosene, and Similar Petroleum Products (ASTM D86).

Kerosene is a water-white, oily liquid distilled from petroleum. It has a boiling range of 180-300° C.

Diesel oil (or fuel oil no. 2) is obtained from the distillation of petroleum. It is composed chiefly of unbranched paraffins and its volatility is similar to that of gas oil.

Gas oil is a liquid petroleum distillate with viscosity and boiling range between those of kerosene and lubricating oil. The boiling range of gas oil is 232-426° C.

A distillate diluent (cutter stock or flux stock) is a petroleum stock used to reduce the viscosity of a heavier residual stock by dilution. Cutter Stock and Gas Oil products are petroleum derivatives used to reduce the viscosity of heavier residual fuel oils so as to meet the exact blend for a specific use. For example, heavy fuel oil can be blended with cutter stock oil to make Residual Fuel Oils and No. 6 Fuel Oil/Bunker-C Oil. Cutter stock may be a refinery stream used to thin a fuel oil or gas oil. Viscosity reduction and sulfur level adjustment provide most of the requirement for the cutter.

Cycle oil is a petroleum product produced by a catalytic cracking unit in the fuel oil or gas oil boiling range. The term "light cycle oil" (LCO) generally describes products of this kind suitable for blending into diesel or home heating oil. "Heavy cycle oil" (HCO) refers to the cat-cracked material which boils at temperatures in the fuel oil range.

BRIEF SUMMARY OF THE INVENTION

It has been found that certain surfactants such as cocamide DEA (also known as "coco(nut) diethanolamide")—a diethanolamide made by reacting the mixture of fatty acids from coconut oils with diethanolamine—when dissolved or dispersed in cutting oils (diesel fuel, light cycle oils, naphtha, and other petroleum distillates) produce a petroleum distillate having significantly enhanced solvency for heavy residuals.

BRIEF DESCRIPTION OF THE SEVERAL VIEWS OF THE DRAWING(S)

FIG. 1 is a bar graph showing percent change in asphalt removal for two different surfactants in diesel after a 2-hour treatment and after an 18-hour treatment [from Example 1].

DETAILED DESCRIPTION OF THE INVENTION

The solvency of a petroleum distillate may be enhanced by dissolving or dispersing a surfactant therein. In one particular exemplary embodiment, 1% by volume cocamide DEA is mixed with diesel oil to create a dispersion or solution useful for cleaning refinery equipment and the like containing heavy residues (asphalt, bitumen or "sludge"). This dispersion or solution may be circulated within sludge-contaminated vessels and optionally heated to dissolve and remove the contaminants. In another embodiment, 2% by volume cocamide DEA is mixed with diesel oil (hereinafter "diesel") to create a dispersion or solution similarly useful for cleaning refinery equipment and the like.

In an exemplary method embodiment, a 1% by volume cocamide DEA dispersion or solution in diesel is circulated in a sludge-containing vessel while being heated to about 140° F. Following an appropriate period of circulation, the enhanced petroleum distillate containing dissolved sludge is pumped from the vessel. Optionally, one or more rinses with an organic solvent and/or water may follow.

Example 1

Evaluation of various additives for refinery-available cleaning oils, such as LCO, diesel and other such petroleum distillates.

Test Specimens

Refinery-supplied asphalt was used for the test specimens. Samples from a 1-gallon can of refinery asphalt were prepared by gouging out a sample approximately 1 inch in diameter from the can. These "chunks" were then weighed in aluminum weigh boats to 0.1-gram accuracy. The samples varied in weight from 9 to 14 grams.

Refinery-Type Solvents

Testing began with solvents obtained from various sources. The original test protocol called for using Light Cycle Oil (LCO) and diesel fuel. However, it was found that the available LCO had significant sulfur content and there were problems with odor. A gallon of Light Vacuum Gas Oil (LVGO) was obtained for evaluation as a substitute for LCO. However, it became apparent throughout the testing that diesel was the better choice. Tests were run using both LVGO and diesel but, due to the viscosity of the LVGO, diesel became the solvent of choice.

Additives

Seven additives were tested. They were:

- a non-ionic, secondary alcohol ethoxylate surfactant ("SAE")
- a proprietary commercial surfactant blend ("s.blend")
- a terpene-based degreaser ("terp")
- isostearyl imidazolinium ethosulfate ("Cola IES")
- a coco diethanol amide ("ColaMulse C356")
- another coco diethanol amide ("ColaMulse D356")
- a tall oil diethanol amide ("Amadol 511")

In all tests, 1% by volume of these additives was used in a petroleum distillate.

Experimental

- Testing was done in a fume hood.
- The heat source was a hot plate (a water bath could be substituted).
- Volume of each test was 100 ml.
- 250-ml beakers were used for each test.
- Surfactant was added with a 1-ml syringe.
- A top-loading balance was used for weighing.

Test Notes:

The first objective was to establish a baseline. The first series of tests was conducted with LVGO and diesel at room temperature (~70° F.) and at 150° F. These are the first 4 tests in Table 1. The chunk of asphalt was weighed and placed in the 250-ml beaker. The test solvents were then added. The 150° F. degree tests were run first.

The LVGO was very viscous. In the 150° F. test, the heat caused the solvent to thin. There was no problem with the diesel. The main problem in these tests was dealing with the sticky asphalt, especially in the heated tests. The heat caused the asphalt to melt and this caused it to stick tightly to the glass beakers. After the 3 hours, the solvent was decanted and the remaining asphalt stuck to the beaker. To determine weight loss, the beaker was dried and weighed. The remaining asphalt was removed and the beaker was reweighed. This was a very slow process. The two tests at 70° F. worked a little better, but were slow and it was difficult to obtain readings.

A different testing procedure was tried in the remaining tests. After the asphalt was weighed in the aluminum weigh boat, it was left in the boat and this was set into the beaker. These tests were conducted for the stated time period. The weigh boats were removed with the asphalt sample and they came out easily. The boat and sample were weighed together and an average weight of aluminum weigh boats was subtracted.

The remainder of the tests were done by this method.

Results and Discussion:

It was observed that the time, temperature, and type of solvent used influenced the effectiveness of asphalt dissolution. When equipment with heavy oil/sludge is cleaned in the field, users typically apply heat to clean the equipment. The reason for running tests at ambient temperature, i.e. 70° F., was strictly for comparison of different solvents, additives, baselines, and for being able to run a large number of tests in a limited time period.

Preliminary Observations:

Diesel was the better solvent tested for the asphalt sample dissolution at low temperature and at high temperature.

The LVGO, used in place of LCO, had very little effect on asphalt at low temperature.

Heavy gas oil (HGO) at 70° F. was found to work slightly better than LVGO. The effect on the asphalt was slow, but it is reasonable to expect that, at higher temperatures, better results would obtain.

Additives are useful for asphalt dissolution in diesel. The first two tested, the non-ionic secondary alcohol ethoxylate (SAE) and the proprietary commercial surfactant blend produced substantially equivalent results in these tests. The 1% solvent-based degreaser was found to be less effective.

Table 1 is from the first series of tests performed singularly.

TABLE 1

| | | | | ASPHALT Weight Loss | | |
|---|---|---|---|---|---|---|
| Solvent | Additive | TEMP | Time | Initial, gm | After, gms | % Removed |
| LVGO | None | 150° F. | 3 hrs. | 10.8 | 4.6 | 57.4 |
| LVGO | None | 70° F. | 2 hrs. | 8.3 | No Loss | No Loss |
| Diesel | None | 150° F. | 3 hrs. | 12.3 | 1.2 | 90.2 |
| Diesel | None | 70° F. | 2 hrs. | 5.4 | 3.4 | 37.0 |
| LVGO | 1% s.blend | 70° F. | 18 hrs. | 9.1 | No loss | No Loss |
| LVGO | 1% SAE | 70° F. | 18 hrs. | 10.5 | No Loss | No Loss |
| LVGO | 1% terp | 70° F. | 18 hrs. | 10 | No Loss | No Loss |
| LVGO | None | 70° F. | 18 hrs. | 10.1 | No Loss | No Loss |
| Diesel | 1% s.blend | 70° F. | 18 hrs. | 9.8 | 4.7 | 52.0 |
| Diesel | 1% SAE | 70° F. | 18 hrs. | 11.2 | 5.2 | 53.6 |
| Diesel | 1% terp | 70° F. | 18 hrs. | 10.3 | 6.2 | 39.8 |
| Diesel | 1% s.blend | 70° F. | 2 hrs. | 9.5 | 7.3 | 23.2 |
| Diesel | 1% SAE | 70° F. | 2 hrs. | 8.5 | 6.3 | 25.9 |
| Diesel | 1% terp | 70° F. | 2 hrs. | 8.7 | 6.8 | 21.8 |
| HGO | None | 70° F. | 2 hrs. | 8.5 | 8.2 | 3.5 |

Test Notes:

1. Using the basic procedure, tests were conducted on refinery-supplied asphalt using various surfactants with diesel. As before, asphalt samples from a 1-gallon can of refinery asphalt were prepared by gouging out a sample from the can approximately 1 inch in diameter. These "chunks" were then weighed in aluminum weigh boats to 0.1-gram accuracy. The weights varied from 9 to 14 grams.

2. For this study, only diesel was used as the solvent.

Surfactant Additives

Three additional additives were tested. The three were SAE, COLA® IES and COLA® Mulse C356 [Colonial Chemical Inc., 225 Colonial Dr. South Pittsburgh, Tenn. 37380 USA], a surfactant blend primarily composed of cocoamide DEA constituents, with linoleic acid diethanol amide (CAS number 56863-02-6) being the predominant constituent. An alternative is Ethox COA™, also described as cocoamide DEA (CAS number 8051-30-7), supplied by Ethox Chemicals, LLC, 1801 Perimeter Road, Greenville, S.C. 29605 USA].

From the experience of previous testing, time, temperature, and type of solvent were found to affect the asphalt dissolution, as well as the surfactant. Most likely, an end user would be applying heat to clean the equipment. Again, the reason for running tests at ambient temperature, i.e. 70° F., was strictly for comparison of different solvents, additives, baselines, and for being able to run a large number of tests in a limited time period.

In the previous lab work, the tests without additives and some with additives left a sticky mess in the glassware. These tests, especially with the COLAMULSE C356, left the beakers very easy to clean. After being rinsed with water and wiped they were ready to use again. Also, the aluminum weigh boats were easier to use.

Although somewhat effective, the COLA IES was not completely soluble in the diesel. The ColaMulse C356 was completely soluble. Twenty-five ml of ColaMulse C356 mixed easily with 75 ml of diesel and remained in solution.

Conclusions:

1. The two diesel samples (no additive) produced similar results in the 18-hr. tests. Therefore, the data should be comparable.
2. Comparing the three surfactants based on amount of asphalt dissolved in the 2-hour tests:
   SAE—37.4%
   Cola IES—53.5%
   ColaMulse C356—65.8%.
3. No 18-hour test was performed using SAE.
4. Cola IES had limited solubility in the solvent.
5. Surfactants added to diesel were beneficial in dissolving asphalt.
6. SAE is a good surfactant, but may not be suitable for a diesel-based cleaner.

Test Notes:

Purpose of Additional Testing

ColaMulse C356 has a relatively low flash point of 94° F. which could make its shipment and use problematic. A chemically similar product with a higher flash point (greater than 200° F.) was identified. This product, ColaMulse D356, was tested to determine its performance versus that of the C356 product.

Results and Discussion:

Table 3 contains the 18-hour, 70° F. results.

The average removal was:

Neat diesel 72% removal.

D356 average was 90%;

Amadol 511 was 76%.

The 2-hour, 70° F. test results were as follows:

Neat diesel removed 29.2%

Diesel+1% D356 removed 43.5%

Diesel+1% Amadol 511 removed 38.6

The neat diesel removal results in the 18-hour tests were higher than previous results. The residual asphalt was very difficult to wash in tests without surfactant. Diesel was used to wash in all tests. Test results may depend, at least in part, on operator technique. There was some thick oil coating the bottom of the weigh boat and some could be washed out with diesel, but the thicker part was difficult to wash.

The appearance of the D536 test residual indicated that there was much less asphalt sample remaining, as the weight proved. There was much less of the thick oil in these tests and it was much easier to wash.

Visual inspection of the Amadol 511-treated asphalt sample did not differ significantly from that of the sample treated with neat diesel, but the weight loss indicated it worked slightly better. The thick oil on the bottom of the boat was about the same as the neat diesel tests.

Conclusions

1. The ColaMulse products are useful as additives for diesel (and most likely other refinery solvents) for removal of heavy hydrocarbons/sludge from process equipment.
2. Time of contact and temperature have significant effect. With adequate temperature along with the best additive, heavy hydrocarbon/sludge removal from crude preheat exchangers, FCCU slurry exchangers, vacuum bottom exchangers and other refinery equipment may be facilitated.

TABLE 2

(results from March 12th testing):

| | | | | | ASPHALT Weight Loss | | | Duplicate |
|---|---|---|---|---|---|---|---|---|
| Solvent | Source | Additive | TEMP | Time | Initial, gms | After, gms | % Remove | Average |
| Diesel | B | None | 70° F. | 2 hours | 12.1 | 8.4 | 30.6 | |
| Diesel | B | None | 70° F. | 2 hours | 12.3 | 8.0 | 35.0 | 32.8 |
| Diesel | B | None | 70° F. | 18 hours | 10.9 | 4.3 | 60.6 | |
| Diesel | B | None | 70° F. | 18 hours | 10.9 | 4.6 | 57.8 | 59.2 |
| Diesel | A | 1% ColaMulse | 70° F. | 2 hours | 9.9 | 3.6 | 63.6 | |
| Diesel | A | 1% ColaMulse | 70° F. | 2 hours | 10.9 | 3.5 | 67.9 | 65.8 |
| Diesel | A | 1% ColaIES | 70° F. | 2 hours | 12.7 | 6.2 | 51.2 | |
| Diesel | A | 1% ColaIES | 70° F. | 2 hours | 12.2 | 5.4 | 55.7 | 53.5 |
| Diesel | A | NONE | 70° F. | 18 hours | 11.1 | 4.9 | 55.9 | |
| Diesel | A | NONE | 70° F. | 18 hours | 10.7 | 4.6 | 57.0 | 56.4 |
| Diesel | A | 1% ColaMulse | 70° F. | 18 hours | 11.2 | 2.8 | 75.0 | |
| Diesel | A | 1% ColaMulse | 70° F. | 18 hours | 10.0 | 3.0 | 70.0 | 72.5 |
| Diesel | A | 1% ColaIES | 70° F. | 18 hours | 10.9 | 3.7 | 66.1 | |
| Diesel | A | 1% ColaIES | 70° F. | 18 hours | 11.7 | 3.9 | 66.7 | 66.4 |
| Diesel | A | 1% SAE | 70° F. | 2 hours | 12.1 | 7.4 | 38.8 | |
| Diesel | A | 1% SAE | 70° F. | 2 hours | 12.8 | 8.2 | 35.9 | 37.4 |

TABLE 3

| Solvent | Source | Additive | TEMP | Times | ASPHALT Weight Loss Initial, gms | After, gms | % Removed | Duplicate Average |
|---|---|---|---|---|---|---|---|---|
| Diesel | A | None | 70° F. | 18 hours | 12.3 | 3.8 | 69.1 | |
| Diesel | A | None | 70° F. | 18 hours | 11.5 | 2.8 | 75.7 | 72.4 |
| Diesel | A | None | 70° F. | 2 hours | 13.8 | 10 | 27.5 | |
| Diesel | A | None | 70° F. | 2 hours | 13 | 9 | 30.8 | 29.2 |
| Diesel | A | 1% ColaMulseD356 | 70° F. | 18 hours | 12.9 | 0.9 | 93.0 | |
| Diesel | A | 1% ColaMulseD356 | 70° F. | 18 hours | 10.6 | 1.4 | 86.8 | 89.9 |
| Diesel | A | 1% ColaMulseD356 | 70° F. | 2 hours | 13.8 | 7.6 | 44.9 | |
| Diesel | A | 1% ColaMulseD356 | 70° F. | 2 hours | 14 | 8.1 | 42.1 | 43.5 |
| Diesel | A | 1% Amadol 511 | 70° F. | 18 hours | 11.9 | 2.6 | 78.2 | |
| Diesel | A | 1% Amadol 511 | 70° F. | 18 hours | 11.3 | 3.0 | 73.5 | 75.8 |
| Diesel | A | 1% Amadol 511 | 70° F. | 2 hours | 13.5 | 8.6 | 36.3 | |
| Diesel | A | 1% Amadol 511 | 70° F. | 2 hours | 12.2 | 7.2 | 41.0 | 38.6 |

Summary Table and Chart of Results

The following tables compare data from the most relevant tests at ambient temperature (~70° F.):

ColaMulse C356 (94° F. Flash Point):

| Solvent | Additive | Time | % Removal | % Increase | % Delta |
|---|---|---|---|---|---|
| Diesel | None | 2-hours | 32.80 | — | — |
| Diesel | None | 18-hours | 56.40 | — | — |
| Diesel | C356 | 2-hours | 65.80 | 100 | 33 |
| Diesel | C356 | 18-hours | 72.50 | 30 | 16 |

ColaMulse D356: (>200° F. Flash Point)

| Solvent | Additive | Time | % Removal | % Increase | % Delta |
|---|---|---|---|---|---|
| Diesel | None | 2-hours | 29.20 | — | — |
| Diesel | None | 18-hours | 72.00 | — | — |
| Diesel | D356 | 2-hours | 43.50 | 50 | 14 |
| Diesel | D356 | 18-hours | 90.00 | 25 | 18 |

FIG. 1 is a graph that compares the percent difference ("delta") versus a baseline diesel-only treatment. The higher the delta, the better the result.

Final Conclusion:

ColaMulse C356 was the best performing additive. However, the flash point of C356 is 94° F. and would be therefore be considered a hazardous material (Hazmat) for shipping, storage, and disposal. This would diminish the appeal of C356 as a packaged product and potentially limit its use.

ColaMulse D356 contains similar active ingredients as C356 but has a flash point above 200° F. D356 did not perform as well as C356, but was the second best additive tested. Lab tests simulated very challenging cleaning conditions at ambient temperature and without agitation. Actual applications in the field would include heat and agitation (fluid circulation, pumping, etc.). Such conditions may be expected to greatly enhance the performance of D356.

The test results would lead to the selection of ColaMulse D356 as the preferred additive from among the tested additives. The high flash point and promising lab performance are most appealing for field use. The economic advantage of using C356 is a reduction in the amount and number of diesel flushes. Lab tests indicated that C356 may enhance diesel solvent effectiveness by at least 50%. This may reduce the amount of diesel needed in a cleaning operation by half or more when the effects of temperature and agitation are taken into consideration.

Example 2

An evaluation of an enhanced petroleum distillate according to an embodiment of the invention on one particular crude tank sludge sample [T1] was conducted. Of interest was the effectiveness of cocamide DEA to enhance the ability of diesel oil to dissolve, disperse and remove sludge at 140° F. The solvent comprised cocamide DEA dispersed in diesel cutter stock. A ratio evaluation of two concentrations of cocamide DEA was selected to evaluate potential vessel-cleaning performance. A laboratory simulation of potential procedural wash steps and water rinsing served as the indication.

Evaluation Testing Protocol

Three samples of the T1 sludge were prepared in beakers by charging 5 g, to each beaker at room temperature. The sample was a solid paste, and would not flow. The beakers were heated in a water bath at 140° F. to simulate likely tank conditions. Diesel washes with and without cocamide DEA were added with periodic swirling to simulate circulation. These were monitored for observation and evaluation. The samples were given a water rinse to evaluate the potential final condition of a tank cleaning. The results of each served as direction for typical procedural guidelines for tank dissolution and flushing.

The following steps were employed for the evaluation process:

1. Set-up: Charge sludge to beakers; three beaker samples were prepared to allow for evaluation of a diesel wash and two cocamide DEA test ratios—1% by volume cocamide DEA in diesel and 2% by volume cocamide DEA in diesel.

2. Heat beakers in a 140° F. water bath
3. Add prescribed diesel solutions
4. Wash 1 and Circulation: 5 g of the test solutions were added to the test samples. The prepared treatment mixtures were swirled periodically to provide agitation and mixing action for the sludge and solvent comprising cocamide DEA in diesel at 140° F. The samples were then observed and decanted.
5. Wash 2 and Circulation: 2.5 g of the test solutions were added to the decanted samples. The prepared treatment mixtures were swirled periodically to provide agitation and mixing action for the sludge and solvent comprising cocamide DEA in diesel at 140° F. The samples were then observed and decanted.
6. Terpene-based degreaser residue wash: 1 g of a terpene-based degreaser wash was added for a final wash with a terpene-based degreaser wash of the residue.
7. Water rinse: The beakers were rinsed with tap water and evaluated for wash removal.

After the diesel wash application step, the sample containers were tilted to allow evaluation of the sample condition. These actions were taken to gauge the general results of cleaning. As per the test protocol, these were decanted and given a second diesel cutter wash. This wash was decanted. A terpene-based degreaser residue wash completed the dissolution and removal. A final evaluation consisted of water rinsing the contents from the beaker to observe the final condition.

Test Actions, Timeline and Visual Results

Set-Up and Washes

All of the test preparations liquefied at 140° F. The viscous nature of the sludge was still evident at the bath temperature. The swirling allowed the diesel cutter washes to mix in penetrating fashion through the sludge from initial surface contact.

Samples were prepared by charging the sludge to beakers. These were heated to 140° F. The samples were then removed from the bath and observed for consistency. All samples were identical in form. Diesel solutions were added to the test beakers to provide the proper test ratios.

Wash 1 results (washes performed at room temperature): The diesel-only washes were inadequate to significantly penetrate and dissolve the sample at ambient conditions. The solutions comprising cocamide DEA in diesel showed better solubility at this point as seen by dissolution at the edges of the samples, and by the loading of the solvents.

Wash 1 results (washes heated for 1 hr.; 5 g wash quantity: Samples were heated and swirled for approx. 1 hour. During this step, all samples reached a stable and consistent state. Due to the thickening of the solutions, further dissolving ceases.

Wash 1 decanted results: There was a significant difference in the samples at this point. The solvents comprising cocamide DEA in diesel removed more of the heavy oil portion of the sample. The diesel-only treated sample had substantial heavy oil remains with the solids. In both samples treated with solvent comprising cocamide DEA in diesel, the heavy oil was significantly removed. The solids observed in each beaker were apparently due to the heavy oil removal.

Wash 2 results (washes were heated for 10 minutes, swirled, and then decanted; 2.4-g wash quantity): There was a remarkable difference in the samples at this point. The additions of solvent comprising cocamide DEA in diesel removed essentially all of the heavy oil portions of the samples. The diesel-only treated sample had substantial heavy oil remains with the solids. Much of the solids in each beaker were removed as well, apparently due to the heavy oil removal.

Terpene-based degreaser wash results (washes heated 10 minutes, 1-g wash quantity, water rinse): A residue wash of a terpene-based degreaser wash was applied to all samples to simulate a final cleaning step. A water rinse was performed on the samples after dissolution to simulate procedural results for a potential tank cleaning. Of particular note was the performance of the terpene-based degreaser wash on the diesel residue test sample. This sample also provided complete dissolution of the sludge residue. The remainder samples had complete removal of the dissolved portions.

Observations

The results of this treatment and evaluation were consistent with prior testing. The test was conducted under the stated conditions to gauge the efficacy of a potential tank cleaning procedure. As seen in prior testing, treatment of the T1 sludge sample at ambient temperature was ineffective with any treatment regimen. The application of heat to keep the tank contents at approximately 140° F. produced acceptable results. The test results indicated that diesel cutter stock enhanced with cocamide DEA reduces the need for additional diesel washes. A terpene-based degreaser wash treatment may suffice for the final residue cleaning. The dissolved portions of the samples were also removed with a water rinse. A field procedure could be somewhat different, but the overall solutions should be the same. These progressive solutions could be easily pumped and removed.

Conclusions

1. Sludge-containing tanks may be effectively cleaned using two diesel cutter wash solutions enhanced with cocamide DEA at 1% by volume. The final clean up need would minimal. As such, there may be an economic advantage to this approach.
2. A terpene-based degreaser wash final degreasing wash may be included to increase the efficacy of the cleaning method. This may be followed by a water rinse to effect final clean-up.
3. Careful attention should be given to the circulation execution and to the use of pump force with the circulations. The sludge is somewhat fluid at 140° F. The terpene-based degreaser wash worked extremely well on this sludge sample, but mixing and agitation may be critical for timely and efficient execution.

Example 3

An evaluation of diesel, 2% cocamide DEA in diesel, and a terpene-based degreaser wash was conducted to estimate the minimum wash ratio for a sample of barge sludge. Of particular interest was the effectiveness of a terpene-based degreaser wash to dissolve, disperse and remove the sludge at 120° F. (expected ambient conditions in a barge). A ratio evaluation of various doses of product/solutions was selected to evaluate potential performance. A laboratory simulation of the sludge as it resides in a barge served as indication.

Evaluation Testing Protocol

Samples of the sludge were prepared in beakers by charging approximately 20 g, to each beaker at room temperature. The sample was a solid paste, and would not flow. The beakers were heated in a water bath at 120° F. to simulate expected barge conditions. Chemical wash additions were added with periodic swirling to simulate circulation. These were monitored for observation and evaluation. The results of each served as direction for typical procedural guidelines for tank dissolution and flushing.

The following steps were employed for the evaluation process.

1. Set-up: Charge sludge to beakers
2. Add prescribed chemical washes; multiple additions: Several additions were made up to a ratio of 15 ml of wash to 20 g of sludge
3. Heat beakers in a 120° F. water bath
4. Circulation: The prepared treatment mixtures were swirled periodically to provide agitation and mixing action for the sludge and chemicals at 120° F.
5. The samples were then visually evaluated.

After the application steps, the samples were tilted to allow evaluation of the sample condition. These actions were taken to gauge the general results for cleaning.

Test Actions, Timeline and Visual Results

Set-Up and Washes

The sludge did not liquefy in the water bath at 120° F. The very viscous nature of the sludge was still evident at the temperature of the bath. The swirling allowed the diesel, 2% cocamide DEA in diesel solution, and the terpene-based degreaser wash to mix through the sludge in penetrating fashion from surface contact. This methodology was chosen to provide a simulation of an actual barge sludge cleaning operation.

Prepared Sludge Samples

Samples were prepared by charging the sludge to beakers. These were heated to 120° F. The samples were removed from the bath and visually observed for consistency. All samples were identical in form. Wash was added to the test beakers to provide the proper test ratios.

Wash Results

The results of this heated dissolution were typical for a hydrocarbon based sludge. At an elevated temperature, washes may completely mix with the sludge. These mixtures may have varied characteristics. The sludge "loads" the solvent portions to produce dissolved liquids that are very similar and liquefied. The diesel wash did not dissolve the sludge completely. The 2% cocamide DEA in diesel solution dissolved much more of the sludge, but dissolution was incomplete. The terpene-based degreaser wash completely dissolved the sludge, leaving only a thin residue.

Conclusions

1. Barge sludge may be effectively cleaned using multiple washes of 2% cocamide DEA in diesel, or with a terpene-based degreaser wash using a ratio of about 20 g of degreaser wash per 15 ml sludge. This equates to using one gallon of terpene-based degreaser wash per 2 gallons of sludge to be removed. The final clean up needed would be minimal. However, inasmuch as a terpene-based degreaser is significantly more expensive than the 2% cocamide DEA in diesel, the use of multiple 2% cocamide DEA in diesel washes may prove to be more economical.

2. It is recommended that careful attention should be given to the circulation execution and to the use of pump force with the circulations. The sludge was somewhat intractable. The terpene-based degreaser wash worked extremely well on this sludge, but mixing and agitation may be critical for efficient execution.

Example 4

An evaluation of diesel, 1% cocamide DEA in diesel cutter, and a terpene-based degreaser wash on a bottom crude tank sludge sample (T2) was conducted. Of interest was the effectiveness of cocamide DEA in diesel to enhance the ability of diesel to dissolve, disperse and remove the sludge. An evaluation of prepared samples was selected to evaluate potential performance. A laboratory simulation of potential procedural wash steps and water rinsing serves as indication.

Testing Protocol

The bottom sample of the T2 sludge was chosen for testing. This sample was decanted to remove any free oil that would flow from the sample jar. The remains were a sludge that would barely flow. This sample was isolated to allow a "worst case" evaluation. Two samples of the T2 sludge were prepared in beakers by charging approximately 6 grams to each beaker at room temperature. The sample was a paste, and would barely flow. Diesel washes with and without cocamide DEA were added with periodic swirling to simulate circulation. These were monitored by visual observation and evaluated. One diesel wash sample and the 1% cocamide DEA in diesel sample were given a terpene-based degreaser wash application after the diesel wash to simulate procedural steps. Finally, these were given a water rinse to evaluate the likely final condition of a tank cleaning. The results of each served as direction for typical procedural guidelines for tank dissolution and flushing.

The following steps were employed in the evaluation process:

1. Set-up: Charge sludge to beakers; three beaker samples were prepared to allow for evaluation of two diesel washes, and a 1% cocamide DEA in diesel wash. 6.2 grams of sludge were added to each.
2. Add prescribed diesel solutions: 6.2 grams of diesel were added to beaker 1; 6.2 grams of 1% cocamide DEA in diesel were added to beaker 2: 6.2 grams of diesel were added to beaker 3.
3. Wash 1 Circulation: The prepared treatment mixtures were swirled periodically to provide agitation and mixing action for the sludge and diesel with added cocamide DEA. The samples were then observed and decanted.
4. Terpene-based degreaser wash residue application: 1 g of terpene-based degreaser wash was added to one diesel-only wash and to the 1 cocamide DEA in diesel wash for a final application to the residue. The second diesel (only) wash was reserved for water wash in order to serve as a baseline comparison.
5. Water rinse: The beakers were rinsed with water and visually evaluated for residue removal.

After the diesel-wash application step, the samples were tilted to allow evaluation of the sample condition.

These actions were taken to gauge the general results for cleaning. As test protocol dictated, these were decanted. A terpene-based degreaser wash residue application completed the dissolution and removal for two samples. A final evaluation consisted of water-rinsing the contents from the beaker to observe the final condition.

Test Actions and Visual Results

Set-Up and Washes

All of the test preparations formed a thick coating of the beakers. The viscous nature of the sludge was still evident after sitting.

Prepared samples: Samples were prepared by charging the sludge to beakers. The samples were identical in form. Diesel solutions were added to the test beakers to provide the desired test ratios. Beaker 1 held the diesel wash; Beaker 2 held the 1% DEA in diesel wash; Beaker 3 held a diesel wash for comparison Wash 1 Decanted Results: Washes Performance at Room Temperature Conditions There was a significant difference observed in the samples at this point. The cocamide DEA in diesel addition completely removed the heavy oil portion of the sample. The diesel-treated samples had substantial heavy oil remains with the solids.

The cocamide DEA in diesel-treated sample had only thin, oily residue.

Wash 2 Results: Terpene-Based Degreaser Wash Applied, Swirled, and Decanted

There was a remarkable difference observed in the samples at this point. The terpene-based degreaser wash application removed all of the heavy oil portions of the 1% cocamide DEA in diesel-washed sample, leaving a very thin residue. The diesel-treated sample had some heavy oil remains with the solids. This is a strong indication of the benefit of the cocamide DEA in diesel. Much of the solids in each beaker were removed as well, apparently due to the heavy oil removal.

Water Rinse Results

A water rinse was performed on the samples after dissolution to simulate procedural results for tank cleaning. Of particular note was the performance of the rinse of the 1% DEA in diesel sample after a terpene-based degreaser wash. Either of these treated with a terpene-based degreaser wash would allow final completion of a tank cleaning, but the sample container washed with DEA in diesel was more completely cleaned. The sample container washed with diesel only and rinsed could not be cleaned of undissolved portions.

Observations

The test was conducted under these conditions to gauge the efficacy of a potential tank cleaning procedure.

Treatment of the T2 sludge was effective with the cocamide DEA in diesel/terpene-based degreaser wash treatment regimen. The test results indicated the cocamide DEA in diesel would perform as expected to reduce the need for additional diesel washes. A terpene-based degreaser wash treatment would likely be adequate for the final residue cleaning. The dissolved portions of the samples treated with a terpene-based degreaser wash were removed with a water rinse. A diesel-only wash was inadequate to remove all oily residue and solids. A field procedure might be somewhat different, but the overall solutions should be comparable. These progressive solutions could be easily pumped and removed.

Conclusions

1. Cleaning a sludge-containing tank with a diesel cutter wash solution of cocamide DEA in diesel at 1% by volume is feasible. The final clean-up need would minimal. As such, there should be an economic advantage in using this method.

2. A terpene-based degreaser final degreasing wash may be included to increase the efficacy of the potential cleaning scheme. This could be followed by a water rinse to effect final clean-up.

3. Careful attention should be given to the circulation execution and to the use of pump force with the circulations. The cocamide DEA in diesel and terpene-based degreaser wash worked extremely well on this test sludge, but mixing and agitation are likely to be critical for efficient execution.

The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A method of cleaning a vessel containing one or more heavy forms of petroleum, said method comprising:

dissolving or dispersing only a fatty acid amide-based surfactant in a petroleum distillate to form a solution or dispersion thereof;

introducing the solution or dispersion into the vessel; and contacting the one or more heavy forms of petroleum with the solution or dispersion.

2. The method recited in claim 1 wherein the fatty acid amide-based surfactant is selected from the group consisting of cocamide DEA, cocamide MEA, cocamidopropyl betaine (CAPE), and cocamidopropyl hydroxysultaine (CANS).

3. The method recited in claim 1 wherein the petroleum distillate is selected from the group consisting of cutter stock, diesel oil, light cycle oil, heavy cycle oil, naphtha, kerosene, light vacuum gas oil, heavy gas oil, and mixtures thereof.

4. The method recited in claim 1 wherein the fatty acid amide-based surfactant is cocamide DEA and the petroleum distillate is diesel oil.

5. The method recited in claim 4 wherein the cocamide DEA surfactant comprises about 1 percent by volume of the solution or dispersion.

6. The method recited in claim 1 further comprising:

soaking the contents of the vessel in the solution or dispersion of the fatty acid amide-based surfactant in the petroleum distillate for a time sufficient to substantially dissolve the contents contained in the vessel.

7. The method recited claim 6 wherein the solution or dispersion of the fatty acid amide-based surfactant in the petroleum distillate is at ambient temperature.

8. The method recited claim 6 wherein the solution or dispersion of the fatty acid amide-based surfactant in the petroleum distillate is maintained at an above-ambient temperature.

9. The method recited in claim 8 wherein the above-ambient temperature is about 140° F.

10. The method recited in claim 1 further comprising:

circulating the solution or dispersion of the fatty acid amide-based surfactant in the petroleum distillate within the vessel.

11. The method recited claim 10 wherein the solution or dispersion of the fatty acid amide-based surfactant in the petroleum distillate is at ambient temperature.

12. The method recited claim 10 wherein the solution or dispersion of the fatty acid amide-based surfactant in the petroleum distillate is maintained at an above-ambient temperature.

13. The method recited in claim 12 wherein the above-ambient temperature is about 140° F.

14. The method of claim 1, wherein the one or more heavy forms of petroleum is crude oil, asphalt, bitumen, or sludge.

* * * * *